US006179589B1

(12) United States Patent
Bass et al.

(10) Patent No.: US 6,179,589 B1
(45) Date of Patent: Jan. 30, 2001

(54) SCROLL MACHINE WITH DISCUS DISCHARGE VALVE

(75) Inventors: Mark Bass, Sidney; Werner H. Prenger, Coldwater; Roy J. Doepker, Lima, all of OH (US)

(73) Assignee: Copeland Corporation, Sidney, OH (US)

( * ) Notice: Under 35 U.S.C. 154(b), the term of this patent shall be extended for 0 days.

(21) Appl. No.: 09/225,054

(22) Filed: Jan. 4, 1999

(51) Int. Cl.[7] ..... F01C 1/02

(52) U.S. Cl. ..... 418/55.1; 418/270; 137/543.19; 137/543.21

(58) Field of Search ..... 418/55.1, 270; 137/543.19, 543.21

(56) References Cited

U.S. PATENT DOCUMENTS

| | | | | |
|---|---|---|---|---|
| 3,473,728 | | 10/1969 | Vulliez . | |
| 4,548,234 | * | 10/1985 | Prenger | 137/543.19 |
| 4,580,604 | * | 4/1986 | Kawaguchi et al. | 418/270 |
| 4,729,402 | * | 3/1988 | Blass et al. | 137/543.19 |
| 4,764,099 | * | 8/1988 | Nakajima et al. | 418/270 |
| 5,346,375 | * | 9/1994 | Akiyama et al. | 418/270 |
| 5,775,894 | * | 7/1998 | Kosco, Jr. | 418/270 |
| 6,027,321 | * | 2/2000 | Shim et al. | 418/270 |

FOREIGN PATENT DOCUMENTS

| | | | | |
|---|---|---|---|---|
| 58-62397 | | 4/1983 | (JP) . | |
| 59-119080 | | 7/1984 | (JP) . | |
| 1-63790 | | 4/1989 | (JP) . | |
| 1-113184 | | 7/1989 | (JP) . | |
| 3-242483 | * | 10/1991 | (JP) | 418/270 |
| 4-279782 | | 10/1992 | (JP) . | |
| 5-18201 | | 1/1993 | (JP) . | |
| 5-157067 | | 6/1993 | (JP) . | |
| 5157066 | | 6/1993 | (JP) . | |
| 5-296164 | | 11/1993 | (JP) . | |
| 5-312158 | | 11/1993 | (JP) . | |
| 6-288375 | | 10/1994 | (JP) . | |
| 7-27061 | | 1/1995 | (JP) . | |
| 7-72544 | | 8/1995 | (JP) . | |

* cited by examiner

*Primary Examiner*—Thomas Denion
*Assistant Examiner*—Theresa Trien
(74) *Attorney, Agent, or Firm*—Harness, Dickey & Pierce, P.L.C.

(57) ABSTRACT

A scroll compressor includes a discharge valve assembly for blocking compressed refrigerant flow from the discharge chamber through the scroll members. This blocking of flow results in an increased performance for the scroll compressor by minimizing the recompression volume due to the configuration of the value assembly and thus the elimination of reverse rotation at shut down. The discharge valve assembly includes a valve seat, a disc shaped valve member, a retainer, a spring and a stop secured within a recess formed within the scroll member.

35 Claims, 8 Drawing Sheets

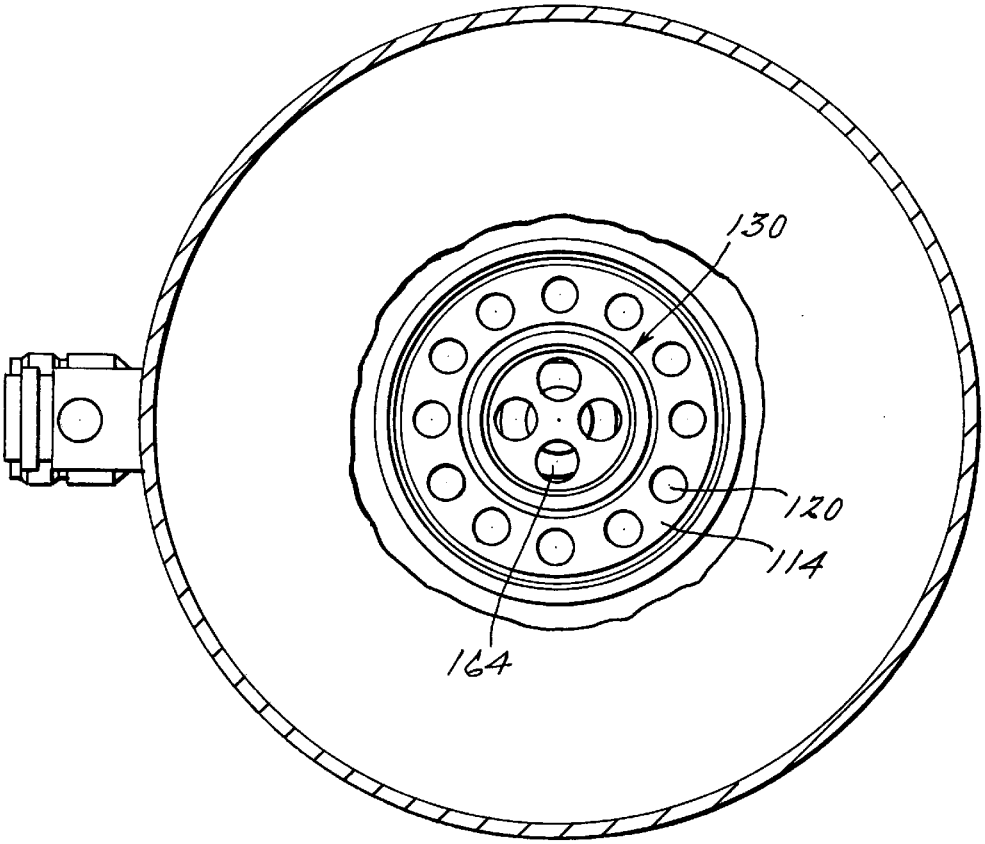
Fig. 2.
Fig. 3.
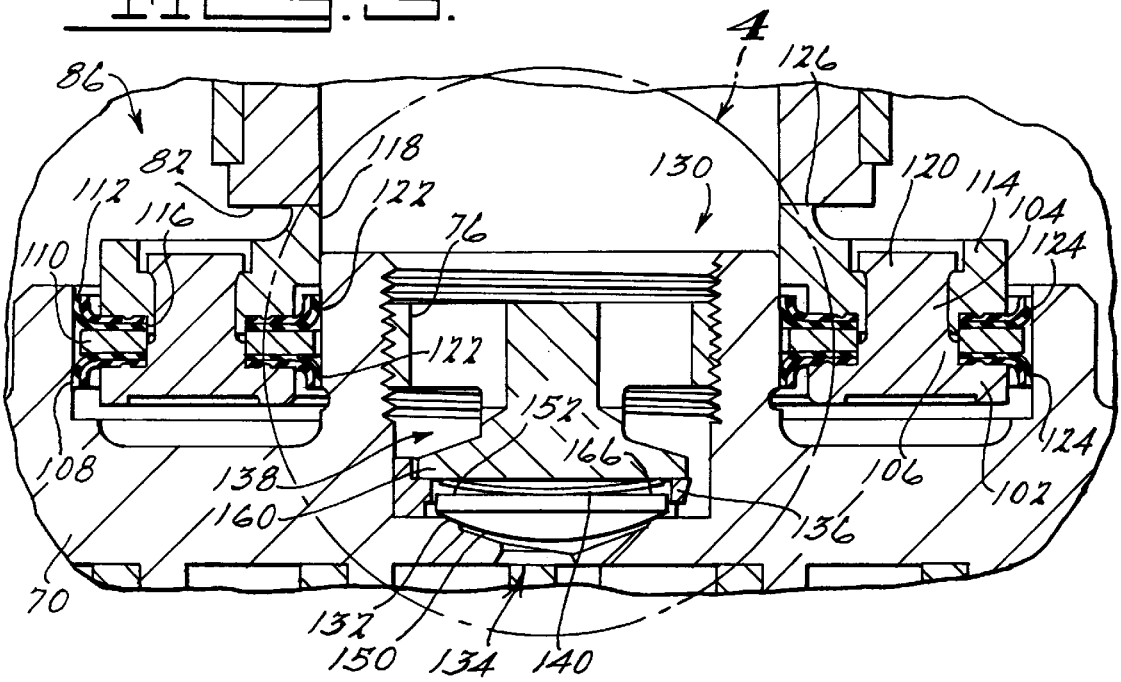

SCROLL MACHINE WITH DISCUS DISCHARGE VALVE

CROSS REFERENCE TO RELATED APPLICATIONS

The present application is related to Assignee's U.S. Pat. Nos. 4,329,125; 4,368,755; 4,385,872; 4,445,534; 4,450,860; 4,470,774; 4,478,243; and 4,548,234.

FIELD OF THE INVENTION

The present invention relates generally to scroll machines. More particularly, the present invention relates to a device increasing the performance of scroll machines and for reducing or eliminating reverse rotation problems in scroll machines such as those used as compressors to compress refrigerant in refrigerating, air-conditioning and heat pump systems, as well as compressors used in air compressing systems.

BACKGROUND AND SUMMARY OF THE INVENTION

Scroll machines are becoming more and more popular for use as compressors in both refrigeration as well as air conditioning and heat pump applications due primarily to their capability for extremely efficient operation. Generally, these machines incorporate a pair of intermeshed spiral wraps, one of which is caused to orbit relative to the other so as to define one or more moving chambers which progressively decrease in size as they travel from an outer suction port towards a center discharge port. An electric motor is normally provided which operates to drive the orbiting scroll member via a suitable drive shaft.

Because scroll compressors depend upon successive chambers for suction, compression, and discharge processes, suction and discharge valves in general are not required. However, the performance of the compressor can be increased with the incorporation of a discharge valve. One of the factors which will determine the level of increased performance is the reduction of what is called recompression volume. The recompression volume is the volume of the discharge chamber and discharge port of the compressor at the time the discharge valve has just closed. The minimization of this recompression volume will result in a maximizing of the performance of the compressor. In addition, when such compressors are shut down, either intentionally as a result of the demand being satisfied, or unintentionally as a result of a power interruption, there is a strong tendency for the backflow of compressed gas from the discharge chamber and to a lesser degree for the gas in the pressurized chambers to effect a reverse orbital movement of the orbiting scroll member and its associated drive shaft. This reverse movement often generates noise or rumble which may be considered objectionable and undesirable. Further, in machines employing a single phase drive motor, it is possible for the compressor to begin running in the reverse direction should a momentary power interruption be experienced. This reverse operation may result in overheating of the compressor and/or other inconveniences to the utilization of the system. Additionally, in some situations, such as a blocked condenser fan, it is possible for the discharge pressure to increase sufficiently to stall the drive motor and effect a reverse rotation thereof. As the orbiting scroll orbits in the reverse direction, the discharge pressure will decrease to a point where the motor again is able to overcome this pressure head and orbit the scroll member in the forward direction. However, the discharge pressure will again increase to a point where the drive motor is stalled and the cycle is repeated. Such cycling is undesirable in that it is self-perpetuating. The incorporation of a discharge valve can reduce or eliminate these reverse rotation problems.

A primary object of the present invention resides in the provision of a very simple and unique discharge valve which is associated with the non-orbiting scroll and which can easily be assembled into a conventional gas compressor of the scroll type without significant modification of the overall compressor design. The discharge valve operates to minimize the recompression volume and at compressor shut down operates to prohibit backflow of the discharge gas through the compressor and thus driving the compressor in the reverse direction. Prohibiting the reverse operation of the compressor eliminates the normal shut down noise and other problems associated with such reverse rotation.

These and other features of the present invention will become apparent from the following description and the appended claims, taken in conjunction with the accompanying drawings.

BRIEF DESCRIPTION OF THE DRAWINGS

In the drawings which illustrate the best mode presently contemplated for carrying out the present invention:

FIG. 2 is a top elevational view of the compressor shown in FIG. 1 with the cap and a portion of the partition removed;

FIG. 3 is an enlarged view of the floating seal assembly and discharge valve assembly illustrated in FIG. 1;

DESCRIPTION OF THE PREFERRED EMBODIMENTS

Figure 1:
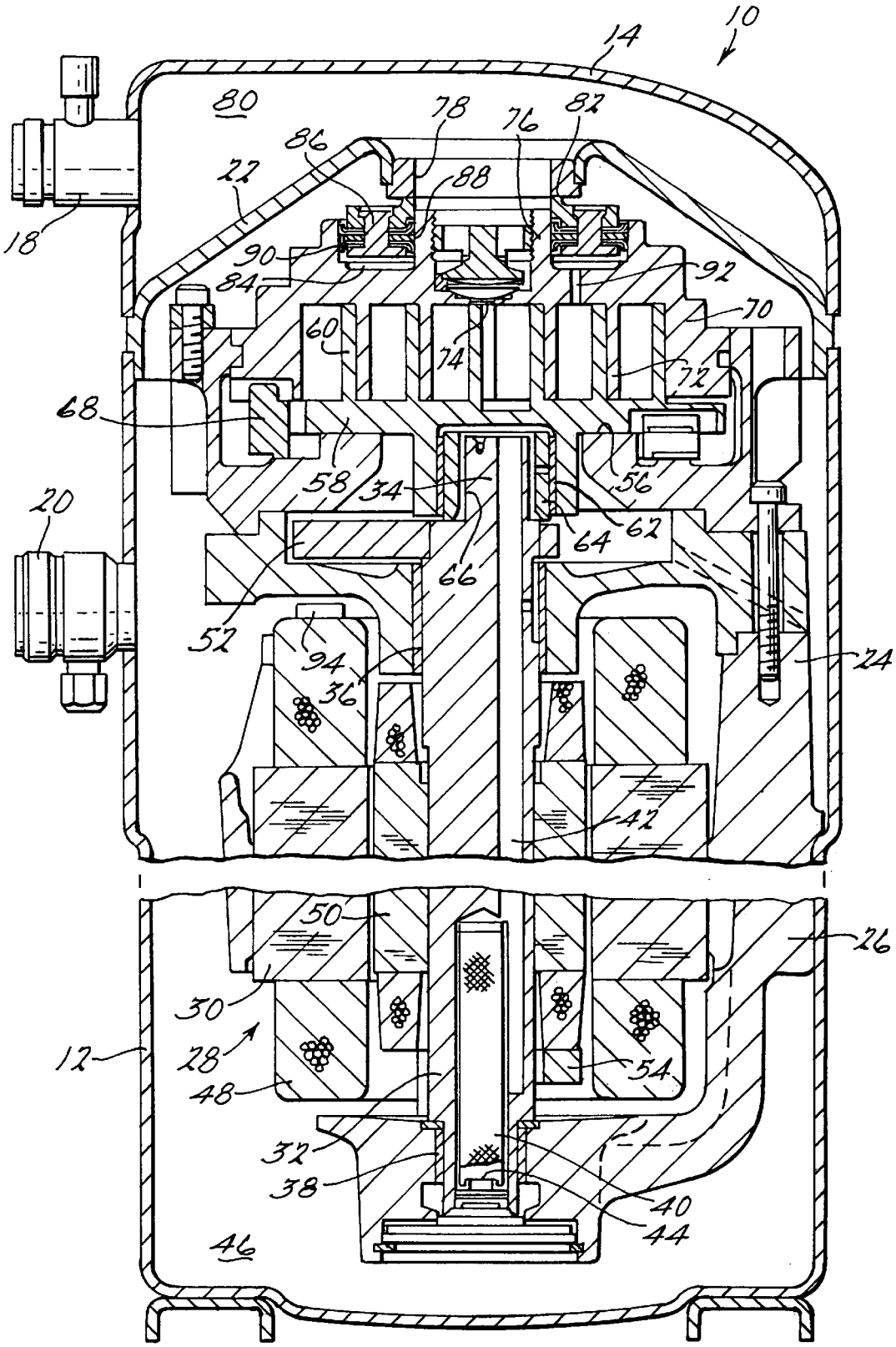
FIG. 1 is a vertical sectional view through the center of a scroll compressor which incorporates a discharge valve assembly in accordance with the present invention.

While the present invention is suitable for incorporation in many different types of compressors, for exemplary purposes it will be described herein incorporated in a scroll refrigerant compressor of the general structure illustrated in FIG. 1. Referring now to the drawings and in particular to FIG. 1, a compressor 10 is shown which comprises a generally cylindrical hermetic shell 12 having welded at the upper end thereof a cap 14. Cap 14 is provided with a refrigerant discharge fitting 18. Other major elements affixed to the shell include an inlet fitting 20, a transversely extending partition 22 which is welded about its periphery at the same point that cap 14 is welded to shell 12 and a two piece main bearing housing 24 and a lower bearing housing 26 having a plurality of radially outwardly extending legs each of which is suitably secured to shell 12. Lower bearing housing 26 locates and supports within shell 12 two piece main bearing housing 24 and a motor 28 which includes a motor stator 30. A drive shaft or crankshaft 32 having an eccentric crank pin 34 at the upper end thereof is rotatably journaled in a bearing 36 in main bearing housing 24 and a second bearing 38 in lower bearing housing 26. Crankshaft 32 has at the lower end a relatively large diameter concentric bore 40 which communicates with a radially outwardly located smaller diameter bore 42 extending upwardly therefrom to the top of crankshaft 32. Disposed within bore 40 is a stirrer 44. The lower portion of the interior shell 12 defines an oil sump 46 which is filled with lubricating oil. Bore 40 acts as a pump to pump lubricating fluid up the crankshaft 32 and into bore 42 and ultimately to all of the various portions of the compressor which require lubrication.

Crankshaft 32 is rotatively driven by electric motor 28 including motor stator 30, windings 48 passing therethrough and a motor rotor 50 press fitted on crankshaft 32 and having upper and lower counterweights 52 and 54, respectively.

The upper surface of two piece main bearing housing 24 is provided with a flat thrust bearing surface 56 on which is disposed an orbiting scroll member 58 having the usual spiral vane or wrap 60 on the upper surface thereof. Projecting downwardly from the lower surface of orbiting scroll member 58 is a cylindrical hub having a journal bearing 62 therein and in which is rotatively disposed a drive bushing 64 having an inner bore 66 in which crank pin 34 is drivingly disposed. Crank pin 34 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An Oldham coupling 68 is also provided positioned between orbiting scroll member 58 and main bearing housing 24. Oldham coupling 68 is keyed to orbiting scroll member 58 and a non-orbiting scroll member 70 to prevent rotational movement of orbiting scroll member 58. Oldham coupling 68 is preferably of the type disclosed in assignee's U.S. Pat. No. 5,320,506, the disclosure of which is hereby incorporated herein by reference.

Non-orbiting scroll member 70 is also provided with a wrap 72 positioned in meshing engagement with wrap 60 of orbiting scroll member 58. Non-orbiting scroll member 70 has a centrally disposed discharge passage 74 which communicates with an upwardly open recess 76 which in turn is in fluid communication via an opening 78 in partition 22 with a discharge muffler chamber 80 defined by cap 14 and partition 22. The entrance to opening 78 has an annular seat portion 82 therearound. Non-orbiting scroll member 70 has in the upper surface thereof an annular recess 84 having parallel coaxial sidewalls in which is sealingly disposed for relative axial movement an annular floating seal assembly 86 which serves to isolate the bottom of recess 84 from the presence of gas under discharge pressure at 88 and suction pressure at 90 so that it can be placed in fluid communication with a source of intermediate fluid pressure by means of a passageway 92. Non-orbiting scroll member 70 is thus axially biased against orbiting scroll member 58 to enhance wrap tip sealing by the forces created by discharge pressure acting on the central portion of non-orbiting scroll member 70 and those created by intermediate fluid pressure acting on the bottom of recess 84. Discharge gas in recess 76 and opening 78 is also sealed from gas at suction pressure in the shell by means of seal assembly 86 acting against seat portion 82. This axial pressure biasing and the functioning of floating seal assembly 86 are disclosed in greater detail in applicant's assignee's U.S. Pat. No. 5,156,539, the disclosure of which is hereby incorporated herein by reference. Non-orbiting scroll member 70 is designed to be mounted to main bearing housing 24 in a suitable manner which will provide limited axial (and no rotational) movement of non-orbiting scroll member 70. Non-orbiting scroll member 70 may be mounted in the manner disclosed in the aforementioned U.S. Pat. No. 4,877,382 or U.S. Pat. No. 5,102,316, the disclosure of which is hereby incorporated herein by reference.

Compressor 10 is preferably of the "low side" type in which suction gas entering via fitting 20 is allowed, in part, to flow into the shell and assist in cooling the motor. So long as there is an adequate flow of returning suction gas the motor will remain within desired temperature limits. When this flow decreases significantly or ceases, however, the loss of cooling will cause a motor protector 94 to trip and shut the machine down.

Referring now to FIGS. 2 and 3, floating seal assembly 86 is of a coaxial sandwiched construction and comprises an annular base plate 102 having a plurality of equally spaced upstanding integral projections 104 each having an enlarged base portion 106. Disposed on plate 102 is an annular gasket assembly 108 having a plurality of equally spaced holes which mate with and receive base portions 106. On top of gasket assembly 108 is disposed an annular spacer plate 110 having a plurality of equally spaces holes which also mate with and receive base portions 106. On top of plate 110 is an annular gasket assembly 112 having a plurality of equally spaced holes which mate with and receive projections 104. The assembly of seal assembly 86 is maintained by an annular upper seal plate 114 which has a plurality of equally spaced holes mating with and receiving projections 104. Seal plate 114 includes a plurality of annular projections 116 which mate with and extend into the plurality of holes in annular gasket assembly 112 and spacer plate 110 to provide stability to seal assembly 86. Seal plate 114 also includes an annular upwardly projecting planar sealing lip 118. Seal assembly 86 is secured together by swaging the ends of projections 104 as indicated at 120.

Referring now to FIG. 3, seal assembly 86 therefore provides three distinct seals. First, an inside diameter seal at two interfaces 122, second an outside diameter seal at two interfaces 124 and a top seal at 126. Seals 122 isolate fluid under intermediate pressure in the bottom of recess 84 from fluid in recess 76. Seals 124 isolate fluid under intermediate pressure in the bottom of recess 84 from fluid within shell 12. Seal 126 is between sealing lip 118 and annular seat portion 82. Seal 126 isolates fluid at suction pressure from fluid at discharge pressure across the top of seal assembly 86.

The diameter and width of seal 126 are chosen so that the unit pressure between sealing lip 118 and seat portion 82 is greater than normally encountered discharge pressure, thus ensuring consistent sealing under normal operating conditions of compressor 10, i.e., at normal operating pressure ratios. Therefore, when undesirable pressure conditions are encountered, seal assembly 86 will be forced downward breaking seal 126, thereby permitting fluid flow from the discharge pressure zone of compressor 10 to the suction pressure zone of compressor 10. If this flow is great enough, the resultant loss of flow of motor-cooling suction gas (aggravated by the excessive temperature of the leaking discharge gas) will cause motor protector 94 to trip thereby de-energizing motor 28.

The scroll compressor as thus far broadly described is either now known in the art or is the subject of other pending applications for patent or patents of applicant's assignee.

The present invention is directed towards a mechanical valve assembly 130 which is disposed within recess 76 which is formed in non-orbiting scroll member 70. Valve assembly 130 moves between a fully closed and a fully open condition during steady state operation of compressor 10. Valve assembly 130 will close during the shut down of compressor 10. When valve assembly 130 is fully closed, the recompression volume is minimized and the reverse flow of discharge gas through scroll members 58 and 70 is prohibited.

Figure 4:
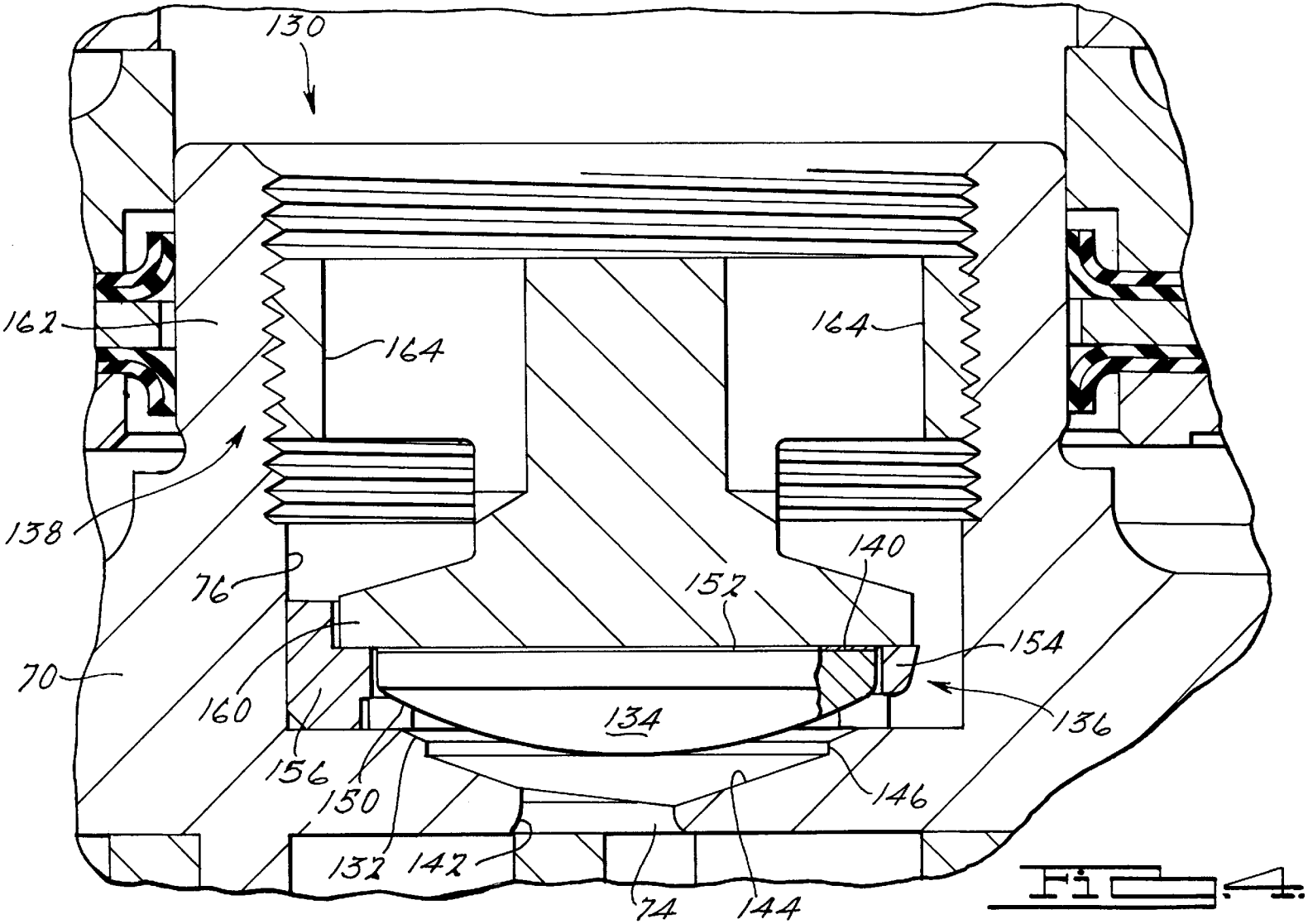
FIG. 4 is an enlarged view of the discharge valve assembly illustrated in FIGS. 1 and 3.
Figure 5:
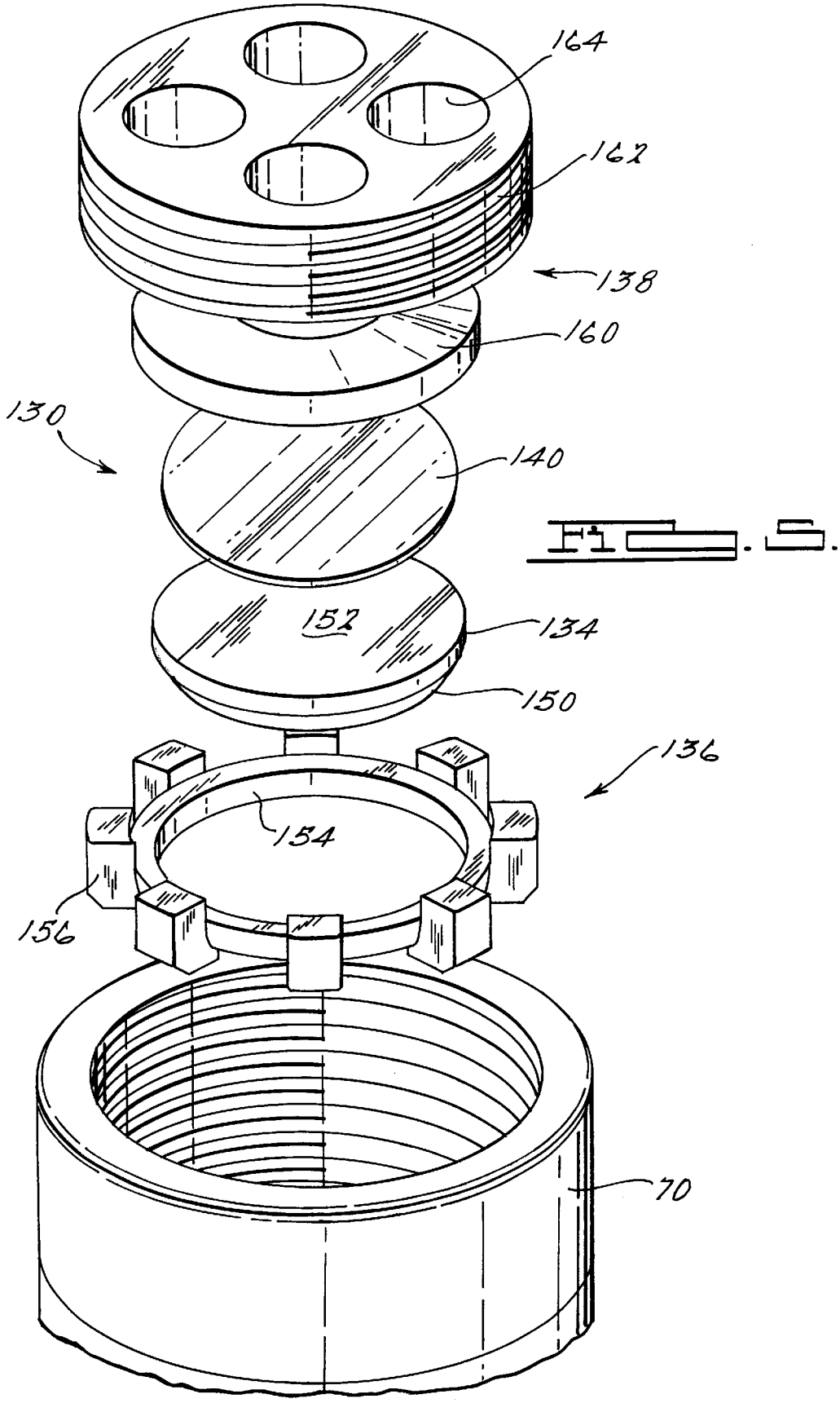
FIG. 5 is an exploded perspective view of the discharge valve assembly shown in FIGS. 1, 3 and 4.

Referring now to FIGS. 3–5, discharge valve assembly 130 is disposed within recess 76 and it comprises a valve seat 132, a disc valve 134, a retainer 136, a retainer nut or stop 138 and a crimp spring 140. Valve seat 132 is formed within non-orbiting scroll member 70 and it comprises discharge passage 74 which has a radiused wall 142 to improve fluid flow and a frusto-conical shaped surface 144 which also improves fluid flow. Valve seat 132 further comprises a step 146 to provide clearance between surface 144 and disc valve 134.

Disc valve 134 defines a generally spherical radiused seat 150 which mates with seat 132 to seal discharge passage 74 and a generally planar surface 152 which mates with crimp spring 140 as will be described later herein. Retainer 136 includes an annular ring 154 and a plurality of legs 156 which are circumferentially spaced around annular ring 154. The outside diameter of legs 156 are sized such that they are slidingly received within recess 76. Legs 156 extend below annular ring 154 to support ring 154 above the bottom surface of recess 76. The distance that ring 154 is supported above the bottom surface of recess 76 is chosen such that disc valve 134 will be guided by the internal diameter of annular ring 154 which is sized to slidingly receive disc valve 134. Legs 156 also extend above annular ring 154 in order to define a pocket for accepting a mushroom shaped stop 160 and thus stabilize the assembled discus valve assembly 130. Retainer nut 138 is threadingly received within recess 76 and it comprises mushroom shaped stop 160 and an annular threaded portion 162 defining a plurality of discharge passages 164. Retainer nut 138 is threaded into recess 76 with mushroom shaped stop 160 engaging the portion of legs 156 which extend above annular ring 154. Tightening of retainer nut 138 seats mushroom shaped stop 160 against annular ring 154 and seats the portion of legs 156 which extend below annular ring 154 against the bottom surface of recess 76. Once tightened, a gap 166 is defined between mushroom shaped stop 160 and planar surface 152 of disc valve 134. Crimp spring 140 is disposed within gap 166 and acts to bias spherical radius seat 150 of disc valve 134 toward valve seat 132 to decrease the time for valve closing which decreases sound and increases efficiency.

Discharge valve assembly 130 moves between a closed position as shown in FIG. 3 and an open position as shown in FIG. 4 based upon the pressure differential across disc valve 134. When in its closed position (FIG. 3), spherical seat 150 of disc valve 134 is biased toward valve seat 132 by crimp spring 140 and the pressure acting against planar surface 152 of disc valve 134. The shape of valve seat 132 is generally spherical and corresponds closely with the shape of spherical seat 150 of disc valve 134 to minimize the recompression volume. The minimum recompression volume will be dictated by the design of scroll wraps 60 and 72. Once this minimum has been defined, the compressor design can approach the minimum value by reducing as much as possible the valve volume associated with passage 74. While it may be possible to have valve seat 132 mirror the shape of spherical seat 150 and thus reduce this valve volume to zero, manufacturing problems as well as performance requirements dictate the cross-sectional area of disc valve 134 exposed to fluid pressure within the compression chambers formed by wraps 60 and 72 be maximized and that the interface between spherical seat 150 and valve seat 132 should approach a line contact. The design detailed above provides feasible manufacturing considerations, maximization of cross-sectional area exposed to compression chamber pressure and a theoretical line contact while minimizing the recompression volume due to the closely corresponding configuration between spherical seat 150 and valve seat 132.

When discharge valve assembly 130 is in its open position, FIG. 4, fluid flows from passage 74 through the passage opened between spherical surface 150 of disc valve 134 and valve seat 132. Fluid flows between the plurality of legs 156 and the wall of recess 76, through the plurality of discharge passages 164 and into discharge muffler chamber 80. The radiused wall of discharge passage 74, the frusto-conical shape of surface 144, the spherical shape of spherical seat 150 and the curved and angular shape on the exterior surface of ring 154 located between adjacent legs 156 provide a smooth flow path for the compressed fluid. This smooth flow path minimizes the losses of Kinetic energy within the fluid as well as acting like a diffuser by progressively opening the passage between the compression chambers formed by wraps 60 and 72 and discharge muffler chamber 80. The opening of discharge valve assembly 130 occurs when the fluid pressure below disc valve seat 132 produces a load which exceeds the load of crimp spring 140 combined with the load produced by the fluid pressure above disc valve seat 132.

During normal operation of compressor 10, disc valve 134 continuously moves between the closed position as shown in FIG. 3 and the open position, as shown in FIG. 4. When in its open position, pressurized refrigerant flows from discharge passage 74, into open recess 76, through the plurality of discharge passages 164 and into discharge muffler chamber 80. This continuous opening and closing of discharge valve assembly 130 significantly improves the performance of compressor 10 due to its design which minimizes the recompression volume. When compressor 10 is shut down either intentionally as a result of the demand being satisfied or unintentionally as a result of a power interruption, there is a strong tendency for the backflow of compressed refrigerant from discharge muffler chamber 80 and to a lesser degree for the gas in the pressurized chambers defined by scroll wraps 60 and 72 to effect a reverse orbital movement of orbiting scroll member 58. When compressor 10 is shut down, the forces due to the pressure differential across disc valve 134 and the load exerted by crimp spring 140 will instantaneously close discharge valve assembly 130 and stop flow of compressed refrigerant out of discharge muffler chamber 80.

Figure 6:
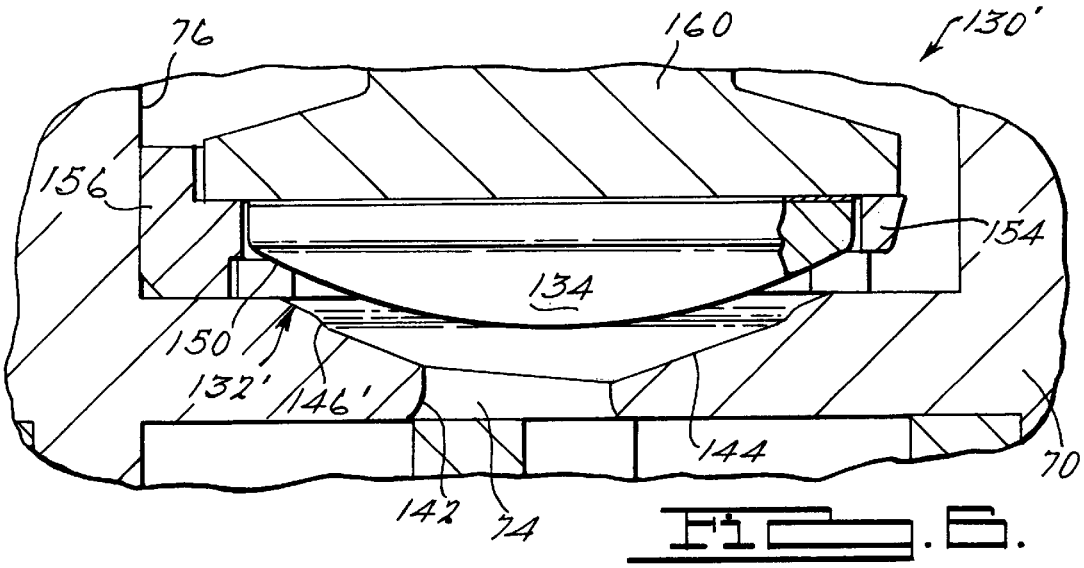
FIG. 6 is an enlarged view similar to FIG. 4 but illustrating a valve seat in accordance with another embodiment of the invention.

Referring now to FIG. 6, a discharge valve assembly 130' is illustrated. Discharge valve assembly 130' is the same as discharge valve assembly 130 except that valve seat 132 is replaced with valve seat 132'. Valve seat 132' comprises a dual radiused step 146' to provide clearance between surface 144 and disc valve 134. The remaining features and operation of discharge valve assembly 130' are identical to discharge valve assembly 130.

Figure 7:
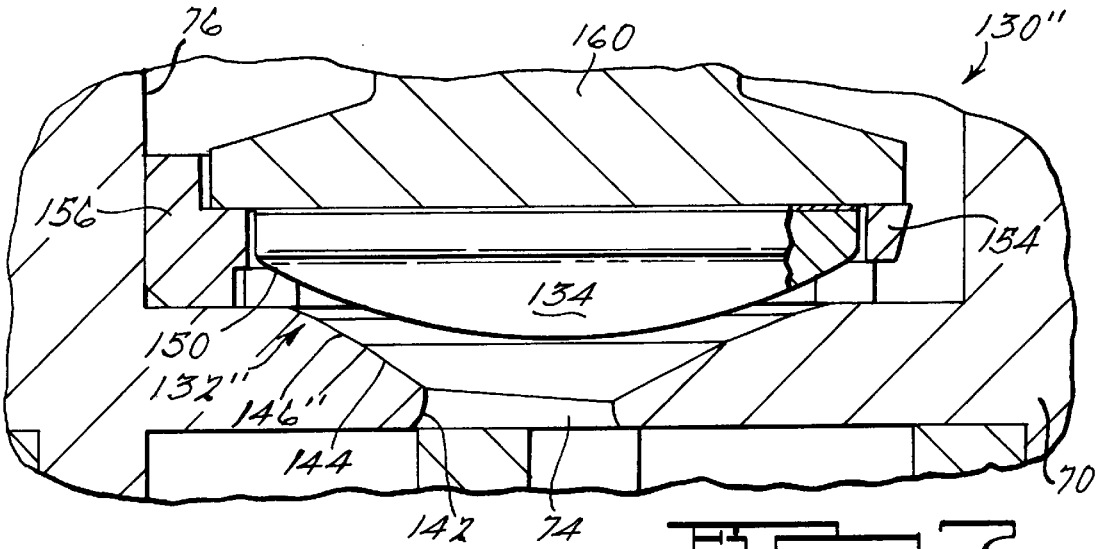
FIG. 7 is an enlarged view similar to FIG. 4 but illustrating a valve seat in accordance with another embodiment of the invention.

Referring now to FIG. 7, a discharge valve assembly 130" is illustrated. Discharge valve assembly 130" is the same as discharge valve assembly 130 except that valve seat 132 is replaced with valve seat 132". Valve seat 132" comprises a frusto-conical shaped surface 146" which preferably defines an included angle of 130°. Surface 146" is relieved to provide clearance at its outer end by having a frusto-conical shaped surface with an included angle greater than 130° and at its interior end by having a frusto-conical shaped surface with an included angle less than 130° to form surface 144. The relief for surface 146" simplifies the manufacturing process while providing a smooth flow surface and reduced re-expansion volume. The remaining features and operation of discharge valve assembly 130" are identical to discharge valve assembly 130.

Figure 8:
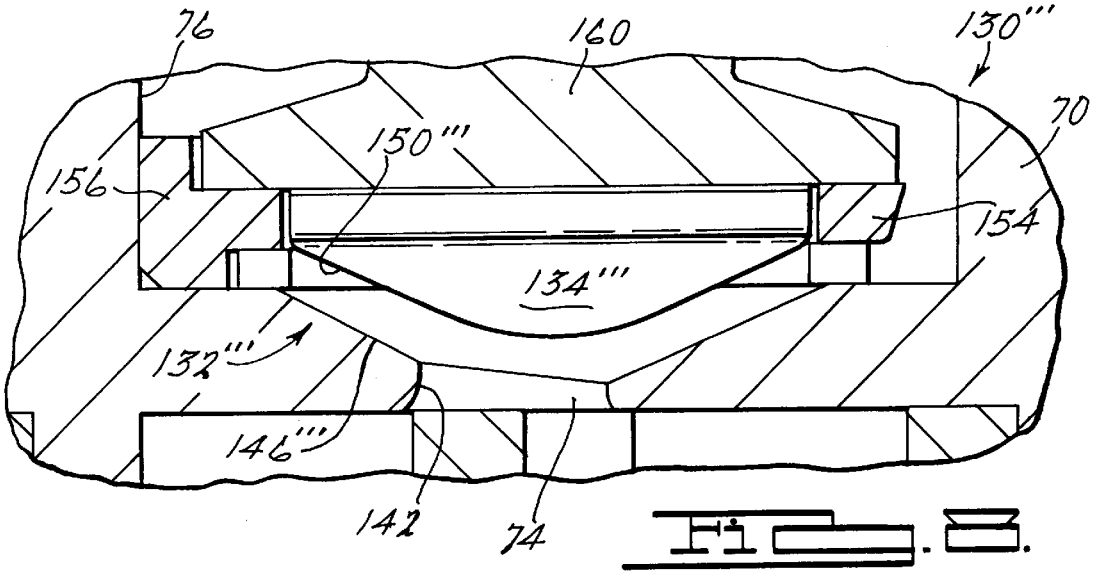
FIG. 8 is an enlarged view similar to FIG. 4 but illustrating a valve seat in accordance with another embodiment of the invention.

Referring now to FIG. 8, a discharged valve assembly 130''' is illustrated. Discharge valve assembly 130''' is the same as discharge valve assembly 130 except that valve seat 130 is replaced with valve seat 132''' and disc valve 134 is replaced with disc valve 134'''. Valve seat 132''' comprises a frusto-conical shaped surface 146''' which preferably defines an included angle of 130°. While not specifically shown in FIG. 7, surface 146''' can be relieved similar to that described above for surface 146". Disc valve 134''' is the same as disc valve 134 except that spherical radiused seat 150 is replaced by frusto-conical seat 150'''. Frusto-conical seat 150''' preferably defines an included angle of 134° with the center portion being radiused rather than being formed to a point. The angular difference between surface 146''' and seat 150''' allows disc valve 134''' to deflect slightly when closing which reduces valve contact stresses and improves valve sealing. Additionally this design provides smooth flow surfaces with a minimum re-expansion volume.

Figure 9:
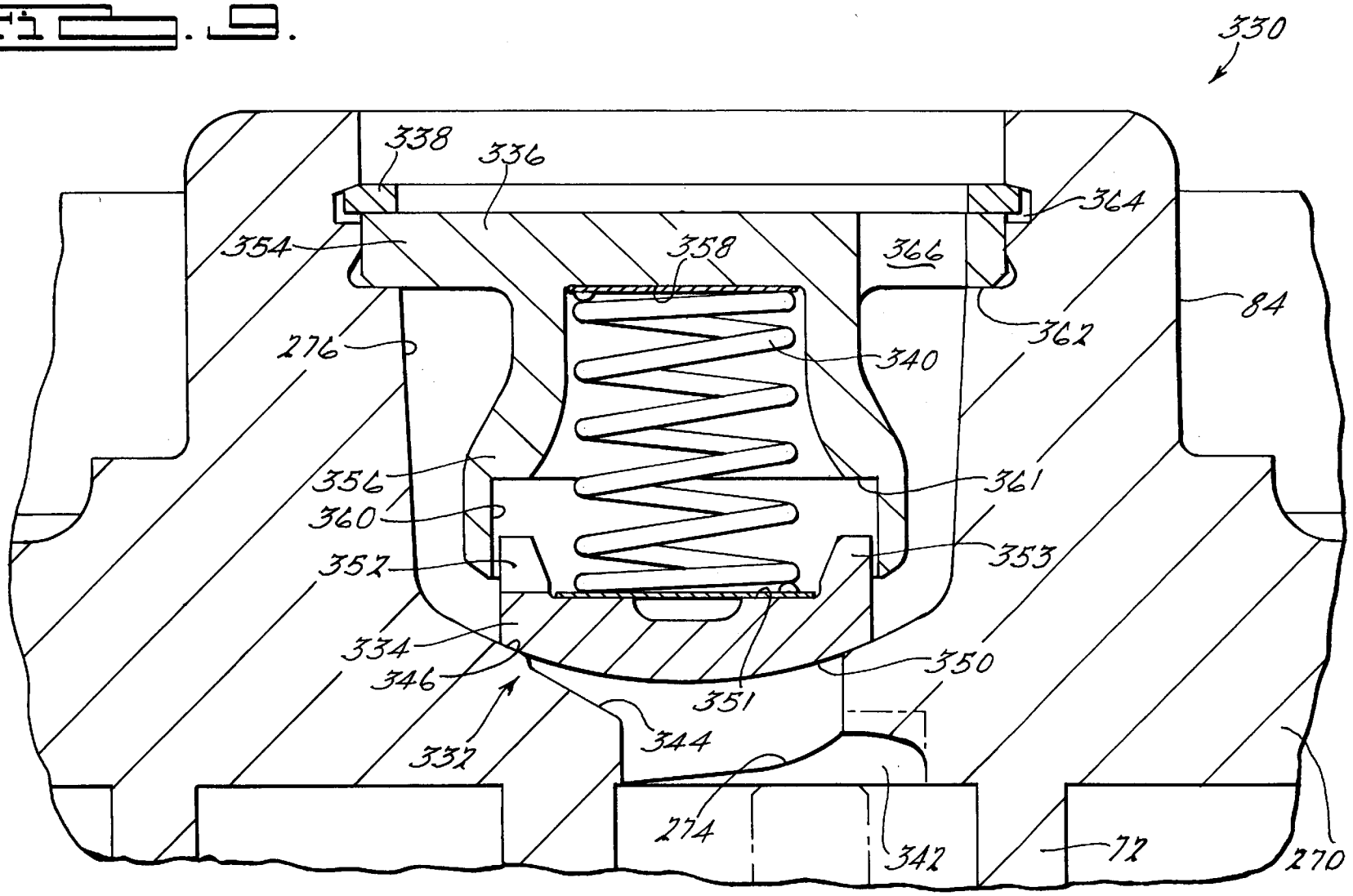
FIG. 9 is an enlarged view similar to FIG. 4 but illustrating a discharge valve assembly in accordance with another embodiment of the present invention.

Referring now to FIG. 9, a discharge valve assembly 330 is shown assembled to a non-orbiting scroll member 270. Non-orbiting scroll member 270 is provided with wrap 72 positioned in meshing engagement with wrap 60 of orbiting scroll member 58. Non-orbiting scroll member 270 has a centrally disposed discharge passage 274 which communicates with an upwardly open recess 276 which in turn is in fluid communication via opening 78 in partition 22 with discharge muffler chamber 80. Non-orbiting scroll member 270 has annular recess 84 in which is sealingly disposed floating seal assembly 86. Non-orbiting scroll member 270 includes passageway 92 and is mounted to main bearing housing 24 in a suitable manner which will provide limited axial (no rotational) movement of non-orbiting scroll member 270 identical to that of non-orbiting scroll member 70.

Discharge valve assembly 330 is disposed within recess 276 and it comprises a valve seat 332, a disc valve 334, a retainer 336, a retaining ring 338 and a coil spring 340. Valve seat 332 is formed within non-orbiting scroll member 270 and it comprises discharge passage 274 which has a ramped port relief 342 to improve fluid flow and a frusto-conical shaped surface 344 which also improves fluid flow. Valve seat 332 further comprises a frusto-conical shaped surface 346 which defines an included angle between 95° and 155° but preferably defines an included angle of approximately 130°. A radiused step between surfaces 344 and 346 provides clearance between surface 344 and disc valve 334.

Disc valve 334 defines a frusto-conical seat 350 which defines an included angle between 95° and 155° but preferably defines an included angle of approximately 134° with the center portion being radiused rather than being formed to a point. The angular difference between surface 346 and seat 350 is between 1° and 10° but preferably it is approximately 4°. This angular difference allows disc valve 334 to deflect slightly when closing which reduces valve contact stresses and improves valve sealing. While the configurations of seat 350 is being described as a frusto-conical seat similar to FIG. 7, the relationship between disc valve 334 and valve seat 332 can be any of the other embodiments described above. Disc valve 334 further defines a spring seat 351 and a plurality of vent slots 352 disposed between adjacent upstanding legs 353. Vent slots 352 permit free movement of disc valve 334 with respect to retainer 336.

Retainer 336 includes an annular ring 354 and a centrally, axially extending annular wall 356. The inside surface of annular wall 356 defines a spring seat 358, a cylindrical bore 360 which slidingly receives disc valve 334 and a stop 361 which limits the movement of disc valve 334. Retainer 336 is disposed against a shoulder 362 formed in non-orbiting scroll 270 and is held in place by retaining ring 338 which seats in a groove 364 formed in non-orbiting scroll 270. Annular ring 354 defines a plurality of passages 366 which permit fluid flow through discharge valve assembly 330 when disc valve 334 is spaced from valve seat 332. Coil spring 340 is disposed between spring seat 351 of disc valve 334 and spring seat 358 of retainer 336 to bias seat 350 of disc valve 334 toward valve seat 332 to decrease the time for valve closing which decreases sound and increases efficiency. The function and the operation of discharge valve assembly 330 is identical to that described above for discharge valve assembly 130.

Figure 10:
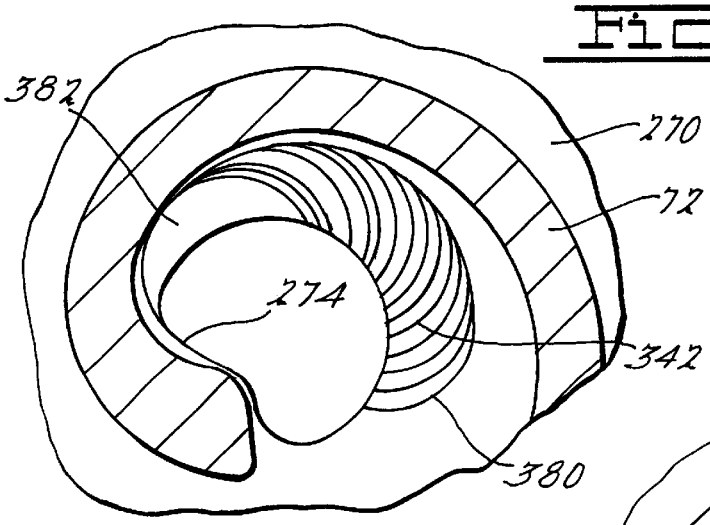
FIG. 10 is a plan view of the non-orbiting scroll shown in FIG. 9 illustrating the ramped port relief for the non-orbiting scroll.

Ramped port relief 342 is shown in FIGS. 9 and 10 and is machined only into non-orbiting scroll member 270. Ramped port relief 342 has a starting point 380 which is flush with the base surface of the end plate of scroll member 270. From starting point 380, ramped port relief 342 progresses downward into the end plate of scroll member 270 until it reaches an end to the ramp 382 which is at a specified depth below the surface of the end plate. Relief 342 is preferably manufactured using the milling cutter which forms discharge passage 274. The motion of the milling cutter necessary to produce ramped port relief 342 is achieved by point-to-point 3-axis motion of a numerically controlled milling machine, or the use of a manual machine with position feedback. The shape of ramped port relief 342 is generated by the cutting action of the milling cutter when moving in the direction parallel to the base surface of the end plate while also feeding axially in the direction perpendicular to the base surface.

Figure 11:
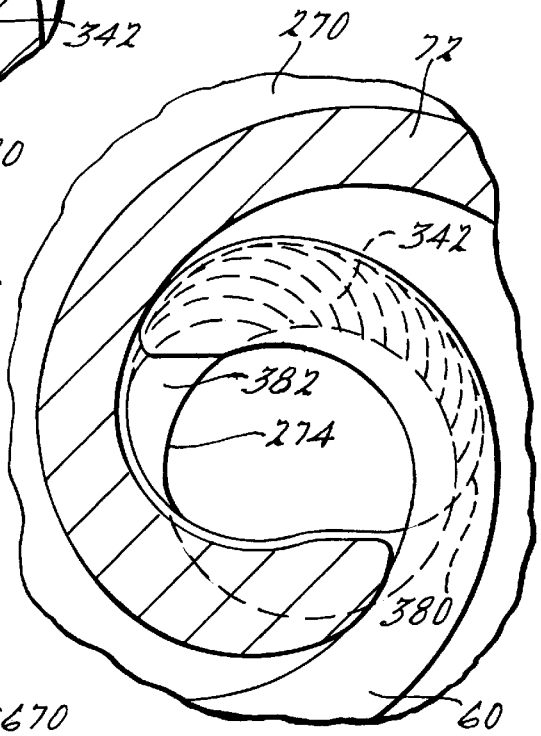
FIG. 11 is a plan view similar to FIG. 10 but showing the non-orbiting and orbiting scroll members just prior to the last point of contact between the tips of the two scroll members.

Ramped port relief 342 is especially beneficial for low and medium pressure ratio applications using an involute profile for the scroll wraps. For these applications, the non-orbiting base area of the central compression pocket is larger than required for the discharge passageway. A ramped port relief is provided to maintain a minimum discharge passageway opening area to keep the center of the discharge passageway on the non-orbiting scroll center and to maintain a smooth gas flow after opening the second compression pocket to the central compression volume. Thus, the edge of the ramped port relief is designed to open at the last point of contact between the tips of the two scroll members or at the point where the second compression pocket opens to the central compression volume as shown in FIG. 11.

The benefits to the ramped port relief include but are non limited to the reduction of the recompression volume by reduction of the discharge passageway opening area, the reduction of restrictions to the gas flow, the control of leakage to slow down the closing or the discharge valve and the ability to choose the placement of the discharge passageway on the non-orbiting scroll center. The benefits of placing the discharge passageway on the non-orbiting scroll center include but are not limited to achieving symmetrical flow and minimum restriction downstream from the valve, allowing the use of larger manufacturing tolerances, lowering the cost of machining for the valve retainer and the discharge passageway, eliminating the requirement for location pin and providing a minimum scroll hub diameter.

Figure 12:
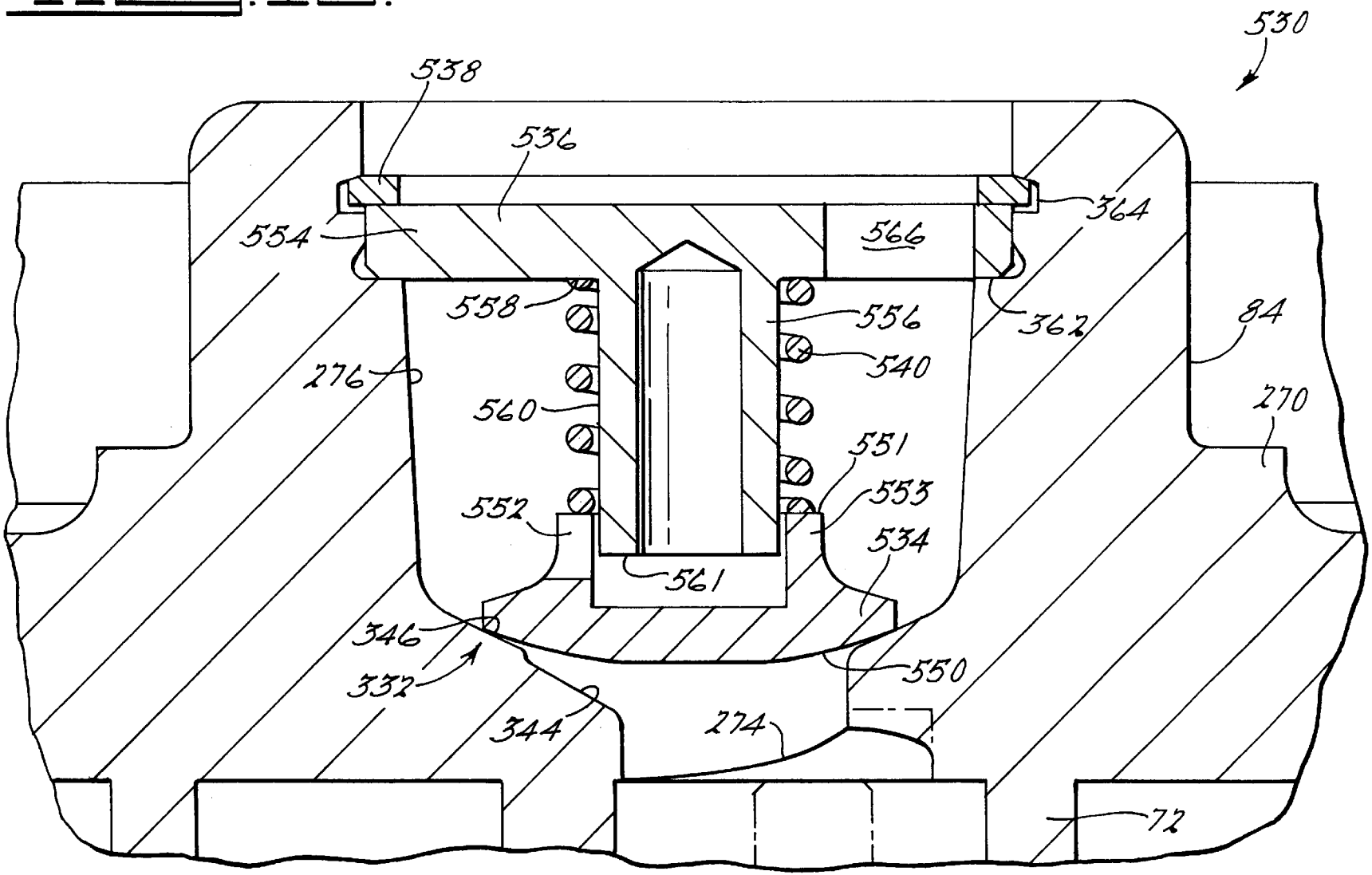
FIG. 12 is an enlarged view similar to FIG. 4 but illustrating a discharge valve assembly in accordance with another embodiment of the present invention.

Referring now to FIG. 12, a discharge valve assembly 530 is shown assembled to non-orbiting scroll member 270. Discharge valve assembly 530 is disposed within recess 276 and it comprises valve seat 332, a disc valve 534, a retainer 536, a retaining ring 538 and a coil spring 540. Valve seat 332 is formed within non-orbiting scroll member 270 and it is described above with reference to FIG. 9.

Disc valve 534 defines a frusto-conical seat 550 which defines an included angle between 95° and 155° but preferably defines an included angle of approximately 134° with the center portion being radiused rather than being formed to a point. The angular difference between surface 346 and seat 550 is between 1° and 10° but preferably it is approximately 4°. This angular difference allows disc valve 534 to deflect slightly when closing which reduces valve contact stresses and improves valve sealing. While the configurations of seat 550 is being described has a frusto-conical seat similar to FIG. 7, the relationship between disc valve 534 and valve seat 332 can be any of the other embodiments described above. Disc valve 534 further defines a spring seat 551 and a plurality of vent slots 552 disposed between adjacent upstanding legs 553. Vent slots 552 permit free movement of disc valve 534 with respect to retainer 536.

Retainer 536 includes an annular ring 554 and a centrally, axially extending post 556. The lower surface of annular ring 554 defines a spring seat 558 and post 556 defines a cylindrical exterior surface 560 which slidingly receive disc valve 534 and coil spring 540 and a stop 561 which limits the movement of disc valve 534. Retainer 536 is disposed against shoulder 362 formed in non-orbiting scroll 270 and is held in place by retaining ring 538 which seats in groove 364 formed in non-orbiting scroll 270. Annular ring 554 defines a plurality of passages 566 which permit fluid flow through discharge valve assembly 530 when disc valve 534 is spaced from valve seat 332. Coil spring 540 is disposed between spring seat 551 of disc valve 534 and spring seat 558 of retainer 536 to bias seat 550 of disc valve 534 toward valve seat 332 to decrease the time for valve closing which decreases sound and increases efficiency. The function and the operation of discharge valve assembly 530 is identical to that described above for discharge valve assembly 130. In addition, ramped port relief 342 is included and provides the same benefits as described above for the embodiment described in FIGS. 9–11.

Figure 13:
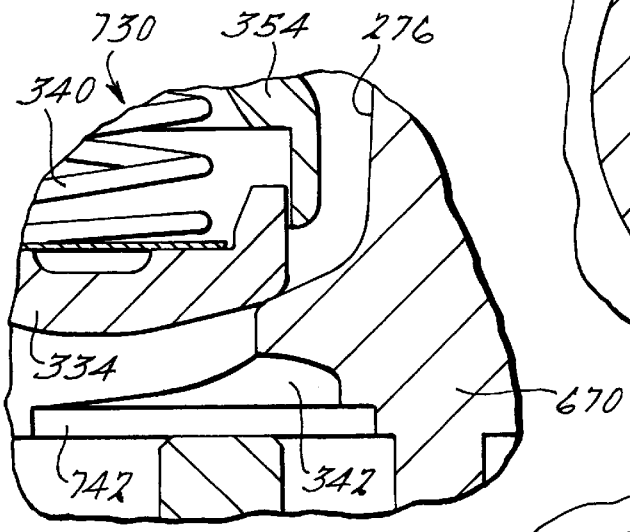
FIG. 13 is an enlarged view similar to FIG. 9 illustrating the non-orbiting scroll with a controlled leakage area in addition to the ramped port relief.
Figure 14:
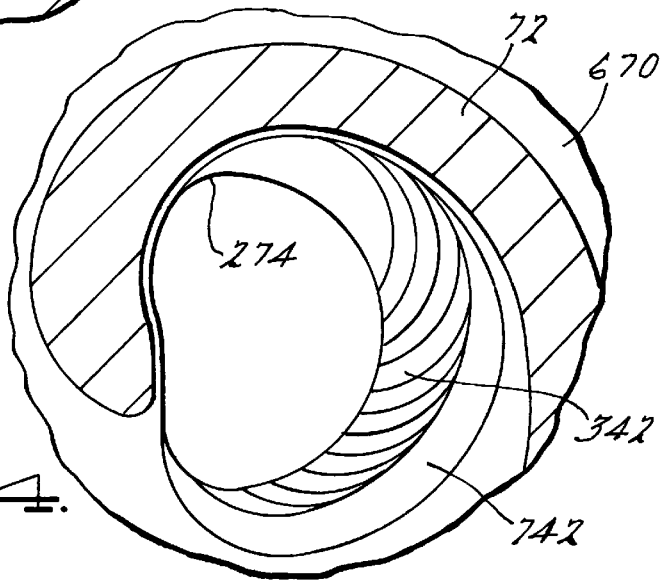
FIG. 14 is a plan view of the non-orbiting scroll illustrating the ramped port relief and the controlled leakage area.

Referring now to FIGS. 13 and 14, a discharge valve assembly 730 is illustrated in accordance with another embodiment of the present invention. Discharge valve assembly 730 is the same as discharge valve assembly 330 with the exception that in addition to ramped port relief 342, a non-orbiting scroll member 670 is provided with a counter bore 742 which provides controlled leakage relief. Counter bore 742 provides a leakage between the second compression space and the central discharge area prior to the parting of the scroll tips to improve sound attenuation. Counter bore 742 is machined into both the non-orbiting scroll member base plate and the orbiting scroll member base plate.

While the above detailed description describes the preferred embodiments of the present invention, it should be understood that the present invention is susceptible to modification, variation and alteration without deviating from the scope and fair meaning of the subjoined claims.

What is claimed is:

1. A scroll machine comprising:

a shell defining a discharge chamber;

a first scroll member disposed in said shell, said first scroll member having a first spiral wrap projecting outwardly from an end plate;

a second scroll member disposed in said shell, said second scroll member having a second spiral wrap projecting outwardly from an end plate, said second spiral wrap intermeshed with said first spiral wrap;

a drive member for causing said scroll members to orbit relative to one another whereby said spiral wraps will create pockets of progressively changing volume between a suction pressure zone and a discharge pressure zone, said discharge pressure zone being in fluid communication with said discharge chamber;

a discharge valve disposed between said discharge pressure zone and said discharge chamber, said discharge valve movable between an open position where fluid flow between said discharge pressure zone and said discharge chamber is permitted and a closed position where fluid flow between said discharge chamber and said discharge pressure zone is prohibited, said discharge valve comprising:

a valve seat disposed within a recess defined by one of said first and second scroll members;

a retainer disposed within said recess adjacent to said valve seat;

a generally circular disc-shaped valve having a non-planar valve surface disposed within said recess and movable between a first position where said non-planar valve surface is adjacent said valve seat to place said discharge valve in said closed position and a second position where said non-planar valve surface is spaced from said valve seat to place said discharge valve in said open position, said retainer engaging said disc-shaped valve for guiding said movement; and a stop disposed within said recess for limiting said movement of said generally circular disc-shaped valve.

2. The scroll machine according to claim 1 wherein, said valve seat includes a radiused inlet and a first frusto-conical surface.

3. The scroll machine according to claim 2 wherein, said valve seat includes a second frusto-conical surface.

4. The scroll machine according to claim 2 wherein, said disc-shaped valve includes a spherical radiused seat, said spherical radiused seat engaging said first frusto-conical surface of said valve seat when said disc-shaped valve is in said position adjacent said valve seat.

5. The scroll machine according to claim 3 wherein, a clearance is provided between a second frusto-conical shaped surface and said spherical radiused seat of said disc-shaped valve when said disc-shaped valve is in said position adjacent said valve seat.

6. The scroll machine according to claim 2 wherein said disc-shaped valve includes a second frusto-conical surface.

7. The scroll machine according to claim 6 wherein said first frusto-conical surface defines a first included angle and said second frusto-conical surface defines a second included angle, said first included angle being smaller than said second included angle.

8. The scroll machine according to claim 7 wherein a difference between said first included angle and said second included angle is between 1 and 10 degrees.

9. The scroll machine according to claim 8 wherein the difference between said first included angle and said second included angle is 4 degrees.

10. The scroll machine according to claim 8 wherein said first included angle is between 95 and 155 degrees.

11. The scroll machine according to claim 10 wherein the difference between said first included angle and said second included angle is 4 degrees.

12. The scroll machine according to claim 10 wherein said first included angle is 134 degrees.

13. The scroll machine according to claim 12 wherein the difference between said first included angle and said second included angle is 4 degrees.

14. The scroll machine according to claim 1 wherein, said stop engages said retainer.

15. The scroll machine according to claim 1 wherein, said retainer comprises an annular ring and a plurality of circumferentially spaced legs.

16. The scroll machine according to claim 15 wherein, said annular ring defines an internal diameter which slidingly receives said disc-shaped valve.

17. The scroll machine according to claim 15 wherein, said plurality of legs extend between said annular ring and a bottom surface of said recess.

18. The scroll machine according to claim 17 wherein, said plurality of legs extend from said annular ring to define a pocket to accept said stop.

19. The scroll machine according to claim 18 wherein, said stop comprises an annular ring and a mushroom shaped stop, said mushroom shaped stop engaging said pocket formed by said plurality of legs of said retainer.

20. The scroll machine according to claim 19 wherein, said annular ring of said stop is threadingly received within said recess.

21. The scroll machine according to claim 15 wherein, said plurality of legs extend from said annular ring to define a pocket to accept said stop.

22. The scroll machine according to claim 21 wherein, said stop comprises an annular ring and a mushroom shaped stop, said mushroom shaped stop engaging said pocket formed by said plurality of legs of said retainer.

23. The scroll machine according to claim 22 wherein, said annular ring of said stop is threadingly received within said recess.

24. The scroll machine according to claim 1 further comprising a biasing member disposed between said disc-shaped valve and said stop for reducing the time required to bring said disc-shaped valve into said position adjacent said valve seat.

25. The scroll machine according to claim 1 wherein said one of said first and second scroll members includes a ramped relief surface.

26. The scroll machine according to claim 25 wherein said one of said first and second scroll members includes a controlled leakage relief.

27. A scroll machine comprising:

a shell defining a discharge chamber;

a first scroll member disposed in said shell, said first scroll member having a first spiral wrap projecting outwardly from an end plate;

a second scroll member disposed in said shell, said second scroll member having a second spiral wrap projecting outwardly from an end plate, said second spiral wrap intermeshed with said first spiral wrap;

a drive member for causing said scroll members to orbit relative to one another whereby said spiral wraps will create pockets of progressively changing volume between a suction pressure zone and a discharge pressure zone, said discharge pressure zone being in fluid communication with said discharge chamber;

a discharge valve disposed between said discharge pressure zone and said discharge chamber, said discharge valve movable between an open position where fluid flow between said discharge pressure zone and said discharge chamber is permitted and a closed position where fluid flow between said discharge chamber and said discharge pressure zone is prohibited, said discharge valve comprising:

a valve seat disposed within a recess defined by one of said first and second scroll members, said valve seat defining a contact surface and a frusto-conical shaped relief surface disposed adjacent said contact surface;

a generally circular disc-shaped valve disposed within said recess and movable between a position adjacent said contact surface of said valve seat to place said discharge valve in said closed position and a position spaced from said contact surface of said valve seat to place said discharge valve in said open position; and a stop disposed within said recess for limiting said movement of said generally circular disc-shaped valve.

28. The scroll machine according to claim 27 wherein, said disc-shaped valve includes a spherical radiused seat, said spherical radiused seat engaging said contact surface of said valve seat when said disc-shaped valve is in said position adjacent said valve seat.

29. The scroll machine according to claim 28 wherein, said contact surface is generally spherical.

30. The scroll machine according to claim 28 wherein, said contact surface is frusto-conical.

31. The scroll machine according to claim 27 wherein, said disc-shaped valve includes a frusto-conical shaped seat, said frusto-conical shaped seat engaging said contact surface of said valve seat when said disc-shaped valve is in said position adjacent said valve seat.

32. The scroll machine according to claim 31 wherein, said contact surface is generally spherical.

33. The scroll machine according to claim 31 wherein, said contact surface is frusto-conical.

34. The scroll machine according to claim 27 wherein, said contact surface is generally spherical.

35. The scroll machine according to claim 27 wherein, said contact surface is frusto-conical.

* * * * *

UNITED STATES PATENT AND TRADEMARK OFFICE

CERTIFICATE OF CORRECTION

PATENT NO. : 6,179,589 B1
DATED : January 30, 2001
INVENTOR(S) : Mark Bass et al.

It is certified that error appears in the above-identified patent and that said Letters Patent is hereby corrected as shown below:

Title page,
Under ABSTRACT, line 6, "value" should be -- valve --.

Column 4,
Line 39, "spaces" should be -- spaced --.

Column 7,
Line 23, "discharged" should be -- discharge --.

Column 9,
Line 28, "has" should be -- as --.

Signed and Sealed this

Fourth Day of December, 2001

*Attest:*

Nicholas P. Godici

NICHOLAS P. GODICI
*Acting Director of the United States Patent and Trademark Office*

*Attesting Officer*